US011805929B2

(12) United States Patent
Nelson et al.

(10) Patent No.: US 11,805,929 B2
(45) Date of Patent: Nov. 7, 2023

(54) BEVERAGE HOLDER

(71) Applicant: Scribe OpCo, Inc., Clearwater, FL (US)

(72) Inventors: Chris Nelson, Dunedin, FL (US); Rachel Rosario, Tampa, FL (US)

(73) Assignee: SCRIBE OPCO, INC., Clearwater, FL (US)

( * ) Notice: Subject to any disclaimer, the term of this patent is extended or adjusted under 35 U.S.C. 154(b) by 53 days.

(21) Appl. No.: 17/188,611

(22) Filed: Mar. 1, 2021

(65) Prior Publication Data

US 2021/0267394 A1 Sep. 2, 2021

Related U.S. Application Data

(60) Provisional application No. 62/982,779, filed on Feb. 28, 2020.

(51) Int. Cl.
*A47G 23/02* (2006.01)
*B65D 81/38* (2006.01)

(52) U.S. Cl.
CPC ..... *A47G 23/0266* (2013.01); *B65D 81/3876* (2013.01); *B65D 81/3886* (2013.01); *B65D 81/3888* (2013.01); *A45F 2200/0583* (2013.01); *A47G 2023/0291* (2013.01)

(58) Field of Classification Search
CPC ..... A47G 23/0266; A47G 23/0216; A47G 23/0208; A47G 2023/0291; A47G 19/2288; B65D 81/3876; B65D 81/3886; B65D 81/3885; B65D 81/3865; B65D 81/3858; B65D 2313/02; B65D 33/165; A45F 2200/0583
USPC .. 220/737, 903, 4.23–4.24, 592.25, 682, 62, 220/739; 224/148.4, 148.6, 674, 250; 229/103.11, 117.06, 403, 198.2; D7/624.2, 619.1, 605, 607–608
See application file for complete search history.

(56) References Cited

U.S. PATENT DOCUMENTS 1,606,538 A * 11/1926 Simeonoff ..... D05B 91/14 220/500
1,683,678 A * 9/1928 Kitterman ..... A45C 3/00 383/22
2,409,820 A * 10/1946 Zimmern ..... A61J 9/08 47/72
3,282,068 A * 11/1966 Cain ..... F25D 3/08 62/530
4,034,926 A * 7/1977 Wegner ..... B65D 85/672 220/4.23
4,197,890 A * 4/1980 Simko ..... F25D 31/007 383/110

(Continued)

FOREIGN PATENT DOCUMENTS

DE 102008057778 A1 * 5/2010 ..... B65D 23/0892
JP 3182669 U * 4/2013
WO WO-2006123931 A2 * 11/2006 ..... F25D 3/08

*Primary Examiner* — J. Gregory Pickett
*Assistant Examiner* — Brijesh V. Patel
(74) *Attorney, Agent, or Firm* — Shumaker, Loop & Kendrick, LLP; James D. Miller

(57) ABSTRACT

A receptacle having a wrap is configured to define a chamber for receiving a container. A pair of slots are formed in the wrap. A first connector is exposed through a first one of the slots and coupled to a surface of the wrap and a second connector exposed through a second one of the slots and coupled to the surface of the wrap.

10 Claims, 6 Drawing Sheets

(56) References Cited

U.S. PATENT DOCUMENTS 4,215,498 A * 8/1980 Wilson ..... G09F 3/18 40/665
4,281,520 A * 8/1981 Norwood ..... F25D 3/08 62/372
4,324,111 A * 4/1982 Edwards ..... B65D 81/3883 53/410
4,413,481 A * 11/1983 Thomas ..... F25D 3/08 62/530
4,540,611 A * 9/1985 Henderson ..... B65D 23/08 428/36.5
D290,922 S * 7/1987 Herrera ..... A47G 23/0216 D21/805
4,890,873 A * 1/1990 Prada ..... A45F 5/10 294/138
5,007,566 A * 4/1991 Fick ..... B62J 11/04 224/438
D316,999 S * 5/1991 Sarff ..... H04B 1/385 D14/138
5,120,108 A * 6/1992 Watson ..... A47C 7/50 297/188.2
D335,614 S * 5/1993 Diab ..... A45C 11/00 D21/805
5,209,367 A * 5/1993 Van Musscher ..... G09F 3/04 229/87.01
5,359,809 A * 11/1994 Johnson ..... A01G 23/04 220/4.24
D360,806 S * 8/1995 Morris ..... F25D 3/08 D7/608
5,445,315 A * 8/1995 Shelby ..... B65D 81/3886 220/592.25
5,622,346 A * 4/1997 Story, Jr. ..... A45F 5/02 224/675
5,653,367 A * 8/1997 Abramson ..... H04B 1/385 224/907
5,813,540 A * 9/1998 Vollbrecht ..... B65D 5/2019 206/427
5,842,633 A * 12/1998 Nurse ..... B65D 81/3886 220/737
D419,392 S * 1/2000 Schlebusch ..... A45F 5/00 D7/619.1
6,053,317 A * 4/2000 Morris ..... B65D 81/3886 206/588
D437,111 S * 2/2001 Bergh ..... A45F 5/021 D3/218
6,286,798 B1 * 9/2001 Chun ..... A47G 23/0216 220/907
6,290,091 B1 * 9/2001 Bell ..... B65D 81/3876 229/405
6,568,576 B1 * 5/2003 Godshaw ..... A45F 5/00 224/655
6,658,664 B1 * 12/2003 Verhoeven ..... A42B 1/22 2/12
6,729,665 B1 * 5/2004 Posey ..... B65D 23/106 215/396
6,904,715 B1 * 6/2005 Lawton ..... A01G 9/026 47/66.3
D508,607 S * 8/2005 Balchunas ..... A45C 1/08 D3/303
D509,354 S * 9/2005 Tannenhauser ..... A45F 5/00 D3/229
D538,113 S * 3/2007 Maxey ..... B65D 81/3876 D7/624.2
D540,125 S * 4/2007 Hicks ..... A01G 9/026 D7/624.2
D541,596 S * 5/2007 Hicks ..... B65D 23/106 D7/624.2
D601,794 S * 10/2009 Jarvio ..... B65D 81/3886 D3/229
7,597,225 B2 * 10/2009 Badillo ..... G03B 17/566 224/675
7,810,683 B2 * 10/2010 Chan ..... A45F 5/00 224/267
7,819,277 B2 * 10/2010 Hanson ..... A45F 5/00 220/737
8,308,033 B2 * 11/2012 Case ..... A45F 5/02 224/250
8,424,712 B2 * 4/2013 Cook ..... A47G 23/0216 220/737
8,573,458 B1 * 11/2013 Hamilton ..... A45F 5/021 224/250
8,622,262 B2 * 1/2014 Van Art ..... A45F 5/00 224/148.2
D704,006 S * 5/2014 Gonzales ..... A01G 23/04 D7/624.2
D750,376 S * 3/2016 Hamilton ..... B26B 29/025 D3/218
9,615,684 B2 * 4/2017 Deakin ..... A45C 11/00
9,688,457 B1 * 6/2017 Healy ..... B65D 33/165
10,030,903 B2 * 7/2018 Nguyen ..... F25D 3/08
D848,799 S * 5/2019 Appelbaum ..... B65D 23/08 D7/624.2
10,531,754 B2 * 1/2020 Rao ..... B65D 81/3806
D899,873 S * 10/2020 Dearing ..... B65D 85/672 D7/624.2
D901,989 S * 11/2020 Gray ..... A47G 23/0216 D7/624.2
10,961,040 B2 * 3/2021 Lee ..... B65D 81/3876
2006/0043097 A1 * 3/2006 Tulp ..... B65D 81/3876 220/737
2006/0283868 A1 * 12/2006 McDonald, II .... B65D 81/3876 220/737
2007/0138188 A1 * 6/2007 Mace ..... B31D 5/0086 220/739
2007/0193908 A1 * 8/2007 Torchia ..... A47G 23/0216 206/427
2008/0047967 A1 * 2/2008 Brunner ..... B65D 81/3886 220/737
2008/0149679 A1 * 6/2008 Case ..... A45F 5/021 224/676
2009/0211062 A1 * 8/2009 Preston-Hall ..... A45C 1/08 24/17 B
2010/0288719 A1 * 11/2010 Rund ..... B65D 23/0842 215/11.6
2012/0285973 A1 * 11/2012 Hargett ..... B65D 81/3876 220/592.24
2016/0270575 A1 * 9/2016 Panone ..... B65D 25/20
2016/0360870 A1 * 12/2016 Langenwalter ..... B26B 29/025
2018/0044082 A1 * 2/2018 Dearing ..... A47G 23/0216
2018/0249853 A1 * 9/2018 Fu ..... B32B 1/08
2019/0008300 A1 * 1/2019 Gräber ..... A47G 23/0216
2021/0052096 A1 * 2/2021 Leatherman ..... A47G 23/0216

* cited by examiner

BEVERAGE HOLDER

CROSS REFERENCE TO RELATED APPLICATIONS

This application claims the benefit of U.S. Provisional Application No. 62/982,779, filed on Feb. 2, 2020. The entire disclosure of the above application is hereby incorporated herein by reference.

FIELD

The present invention relates to a receptacle for beverage containers and more particularly to an expandable receptacle for a beverage container having an elastic feature.

BACKGROUND OF THE INVENTION

As commonly known, various types of receptacles, such as sleeves or jackets, are employed to insulate beverage containers, militate against condensation forming on an outer surface of the beverage containers, provide a surface for promotional or identifying indicia, and/or act as a barrier between the beverage container and a hand of a holder of the beverage container. For example, receptacles are often used to receive carbonated beverage containers such as aluminum cans typically employed to contain water, soda, beer, or similar types of beverages.

However, often, the receptacles are not desireably expandable to accommodate various types of beverage containers or require undesired effort to insert the beverage container into the receptacle. Additionally, the manufacturing is undesireably complex. Furthermore, the typical receptacles known are difficult to print or apply indicia thereon.

Therefore, it would be desired to have an easily manufactured receptacle that is ergonomically designed, maximizes efficiency of applying indicia thereto, and easily expandable to accommodate various containers while maintaining desired insulation and militates against condensation forming on an outer surface of the container.

SUMMARY OF THE INVENTION

In accordance and attuned with the present invention, an easily manufactured receptacle that is ergonomically designed, maximizes efficiency of applying indicia thereto, and easily expandable to accommodate various containers while maintaining desired insulation and militates against condensation forming on an outer surface of the container, has surprisingly been discovered.

In a first embodiment, a receptacle is disclosed including a wrap configured to define a chamber for receiving a container. A pair of slots are formed in the wrap. A first connector is exposed through a first one of the slots and coupled to a surface of the wrap.

In a second embodiment, a receptacle is disclosed. The receptacle includes a wrap configured to define a chamber for receiving a container. A pair of slots are formed in the wrap. A first connector is exposed through a first one of the slots and coupled to a surface of the wrap and a second connector is exposed through a second one of the slots and coupled to the surface of the wrap.

In a third embodiment, a receptacle is disclosed. The receptacle includes a wrap configured to define a chamber for receiving a container. A pair of slots are formed in the wrap. A first connector is exposed through a first one of the slots and coupled to a surface of the wrap. A second connector is exposed through a second one of the slots and coupled to the surface of the wrap, wherein the first connector and the second connector have include a first strap and a second strap.

BRIEF DESCRIPTION OF THE DRAWINGS

The above advantages of the invention will become readily apparent to those skilled in the art from reading the following detailed description of an embodiment of the invention in the light of the accompanying drawings.

DETAILED DESCRIPTION OF THE PREFERRED EMBODIMENT

Figure 1:
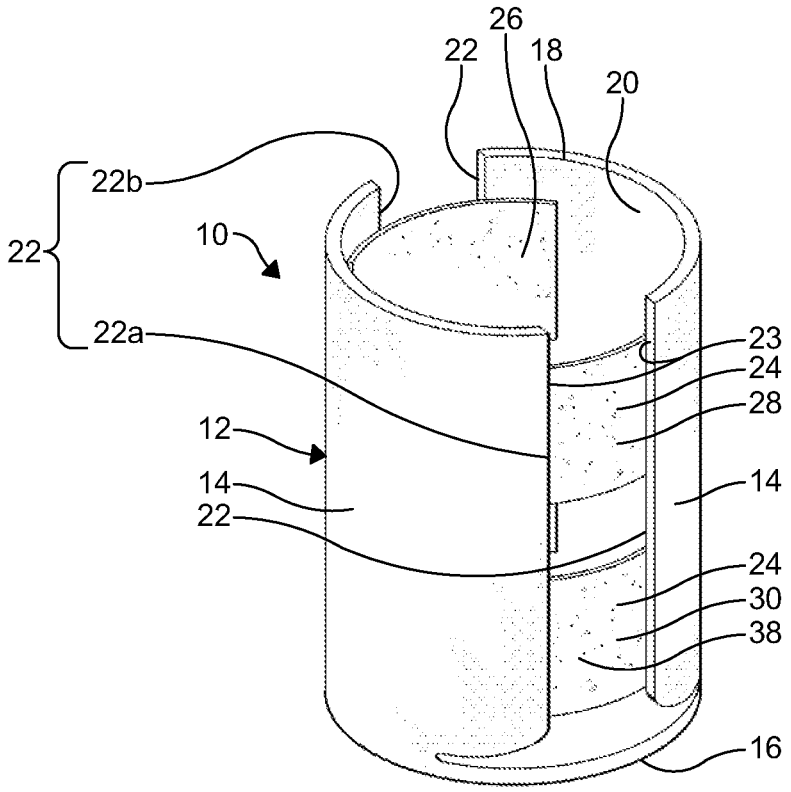
FIG. 1 is a top perspective view of a receptacle according to an embodiment of the instant disclosure, wherein the receptacle is in an expanded position.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

A" and "an" as used herein indicate "at least one" of the item is present; a plurality of such items may be present, when possible. Spatially relative terms, such as "front," "back," "inner," "outer," "bottom," "top," "horizontal," "vertical," "upper," "lower," "side," "above," "below," "beneath," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

As used herein, substantially is defined as "to a considerable degree" or "proximate" or as otherwise understood by one ordinarily skilled in the art or as otherwise noted. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer The present technology relates to receptacles, such as a sleeve, for receiving containers, such as aluminum cans or bottles, glass, cans or bottles, or similar. For example, the cans or bottles can contain carbonated beverages such as soda pop, beer, sparkling water, or seltzer, juice, water, milk, or similar type beverages. The cans or bottles are typically of the 12 ounce variety. However, it is understood the receptacle can be configured for containers containing any fluid, solid, semi, solid, or combination thereof. Additionally, the receptacle can be configured to hold any volume or weight. As shown throughout the disclosure, the receptacle is configured to receive a cylindrically bodied container. However, the receptacle can receive any shape of container as desired such as cubical, spherical, conical, cuboidal, triangular prism, ovular, a combination thereof, or any other shape as desired, for example.

Figure 11:
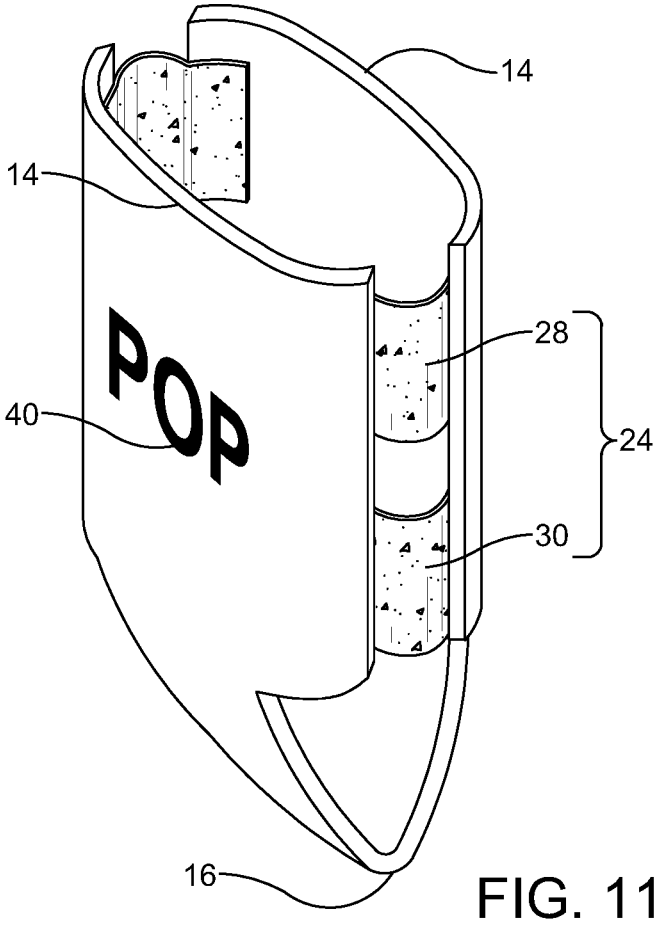
FIG. 11 is a top perspective view of the receptacle of FIGS. 1-5 in a collapsed position.
Figure 12:
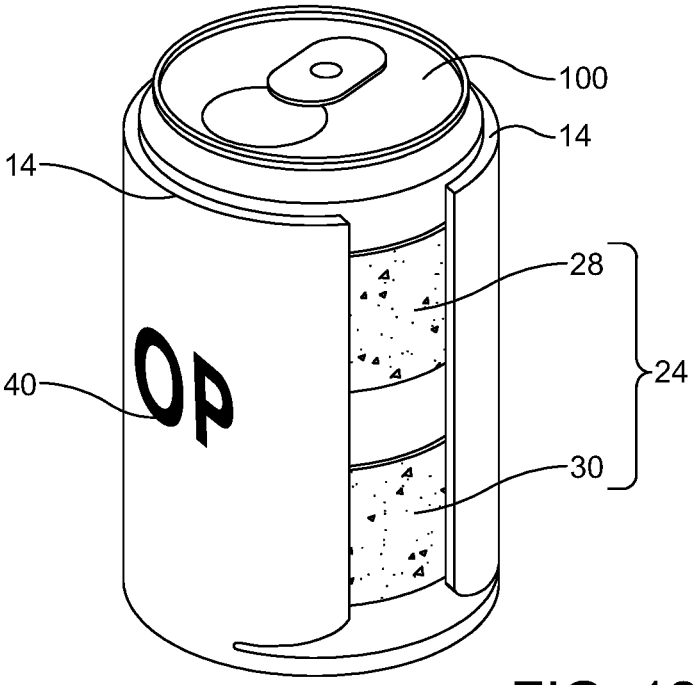
FIG. 12 is a top perspective view of the receptacle of FIGS. 1-5 receiving a container.
Figure 13:
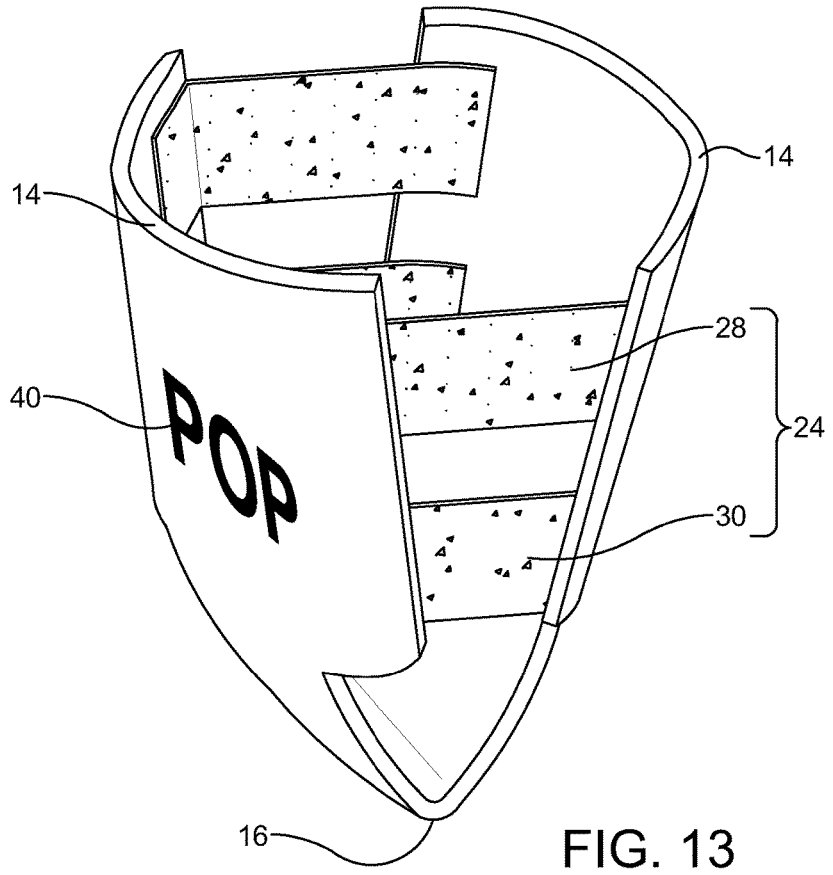
FIG. 13 is a top perspective view of the receptacle of FIGS. 1-5 in an extended position.
Figure 14:
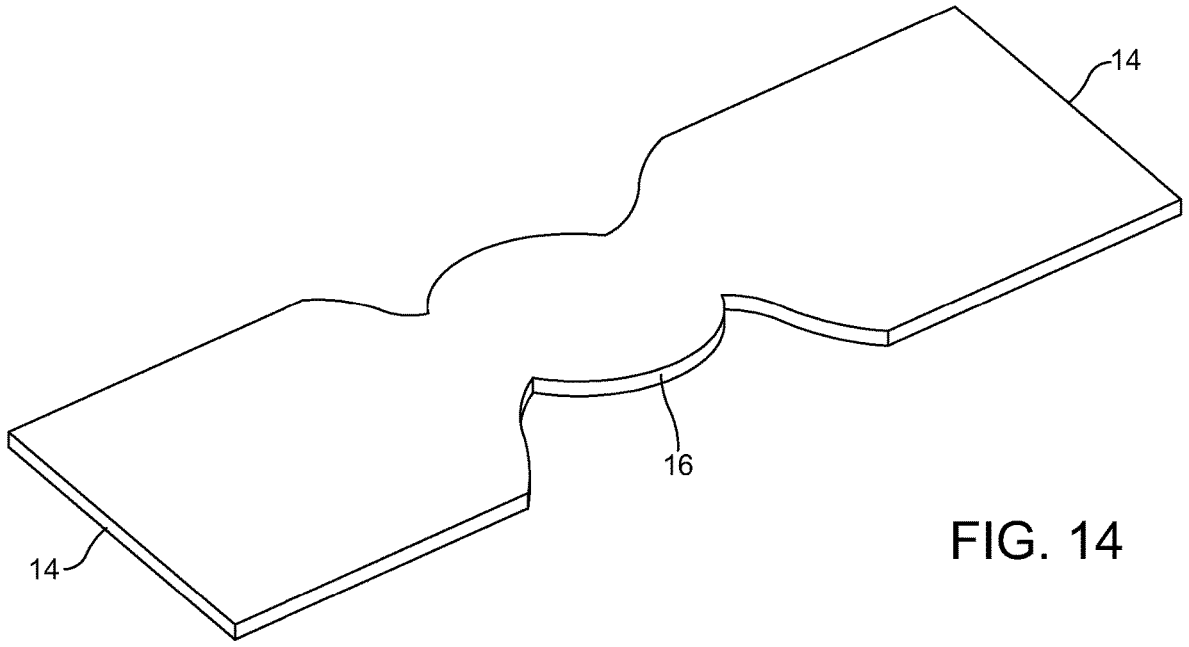
FIG. 14 is a top plan view of a wrap of the receptacles of FIGS. 1 and 6 formed from a blank.

FIGS. 1-5 and 11-13 show a receptacle 10 according to an embodiment of the disclosure. The receptacle 10 can be positioned between an open or expanded position as shown in FIGS. 1-5 and 12, a collapsed position as shown in FIG. 11, and a stretched or extended position as shown in FIG. 13. The receptacle 10 includes a single continuous wrap 12 formed from a blank of material. As used herein, continuous means without interruption, an unbroken whole, or seamless. In the example illustrated, the wrap 12 is formed from the same one piece of material and has not been formed from multiple pieces of materials joined together. However, it is understood the wrap 12 can be formed from multiple portions of material integrated or coupled together with each other.

The wrap 12 includes a pair of sides 14 and a bottom 16 continuously formed with each other. The wrap 12 includes an opening 18 opposite the bottom 16. The bottom 16 is substantially linear extending between the sides 14 when in the expanded position or the extended position, wherein the sides 14 extend from an outer perimeter of the bottom 16. In the collapsed position, the bottom 16 folds upon itself to move the sides 14 towards each other. In the collapsed position, the sides 14 extend between a position substantially linear with a portion of the bottom 16 or forming an arcuate shape with a portion of the bottom 16.

Figure 2:
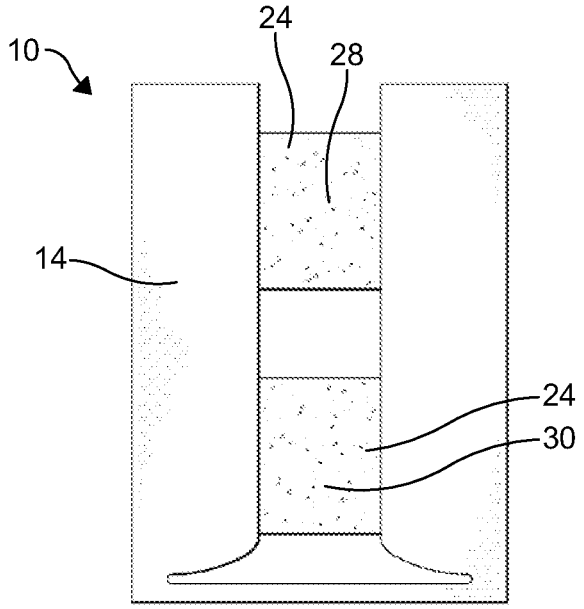
FIG. 2 is a left side elevational view of the receptacle of of FIG. 1.
Figure 3:
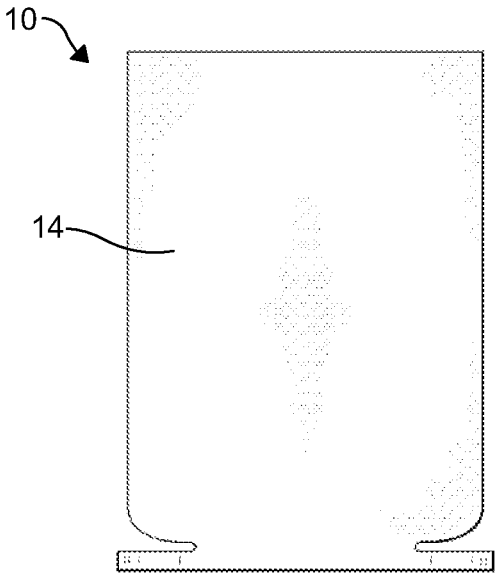
FIG. 3 is a front elevational view of the receptacle of FIGS. 1-2.
Figure 4:
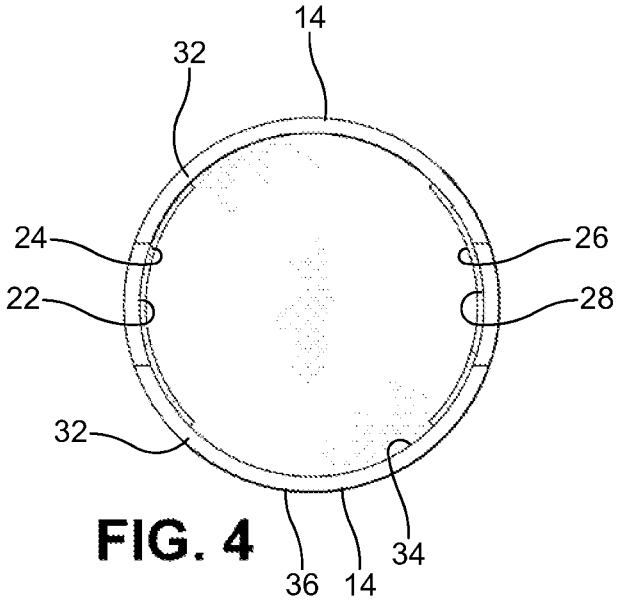
FIG. 4 is a top plan view of the receptacle of FIGS. 1-3.
Figure 5:
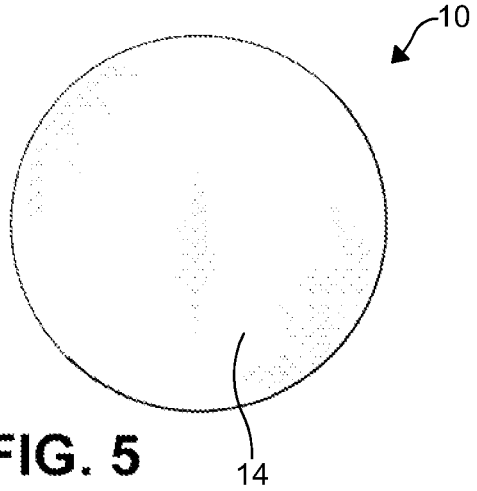
FIG. 5 is a bottom plan view of the receptacle of FIGS. 1-4.
Figure 6:
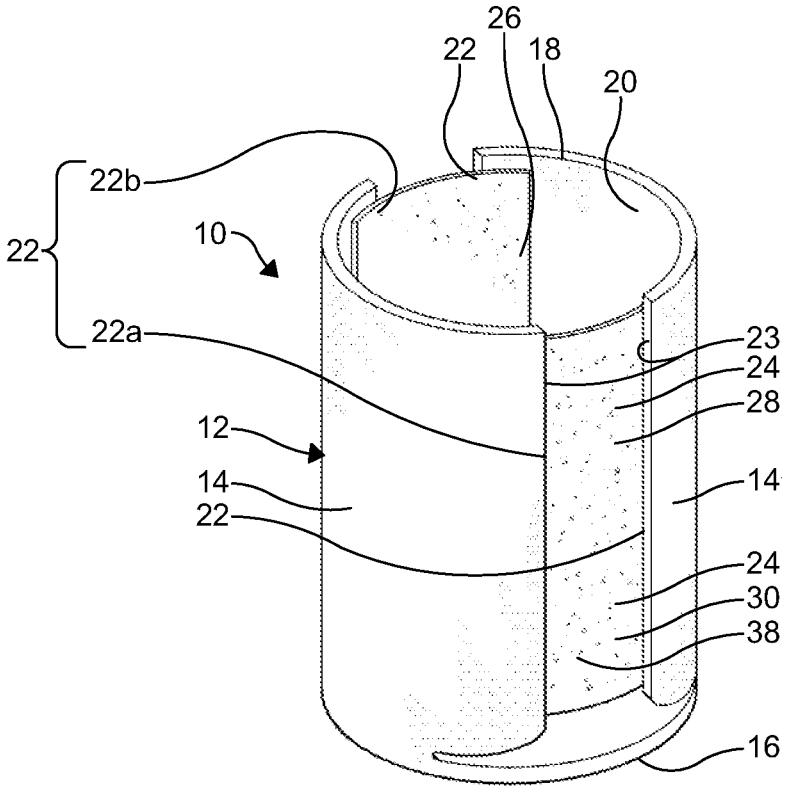
FIG. 6 is a top perspective view of a receptacle according to another embodiment of the instant disclosure.
Figure 7:
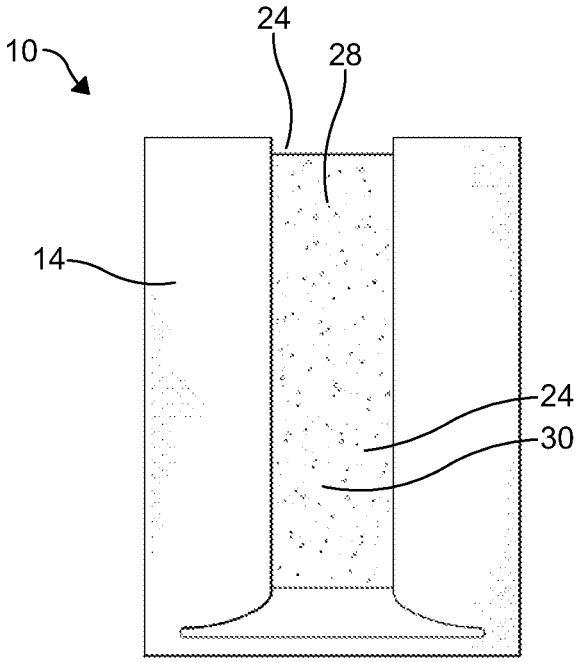
FIG. 7 a left side elevational view of the receptacle of FIG. 6.
Figure 8:
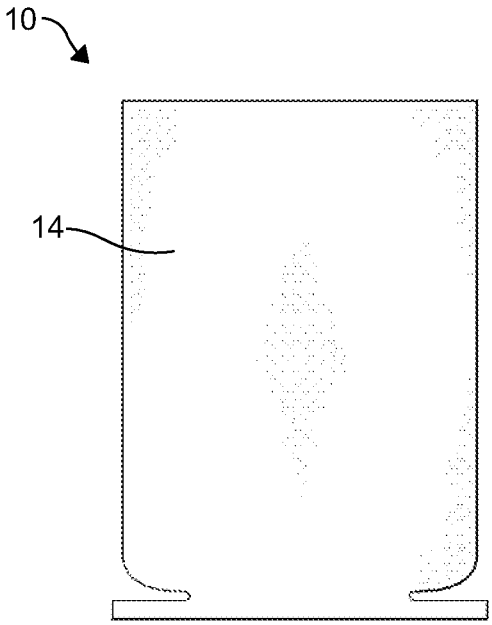
FIG. 8 is a front elevational view of the receptacle of FIGS. 6-7.
Figure 9:
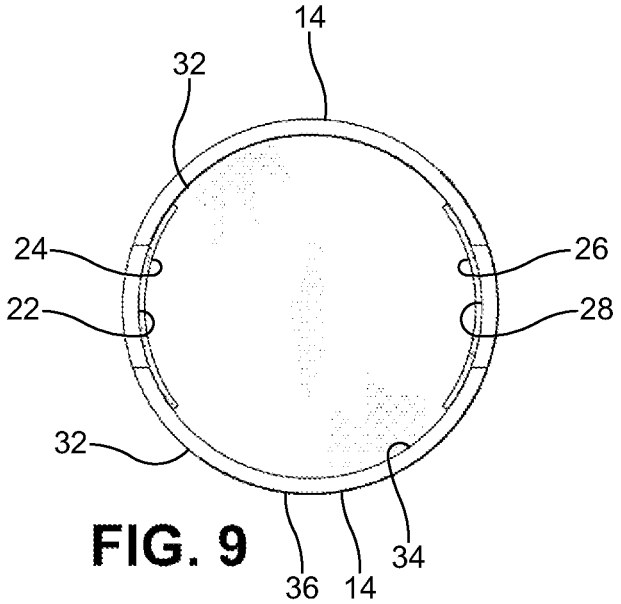
FIG. 9 is a top plan view of the receptacle of FIGS. 6-8.
Figure 10:
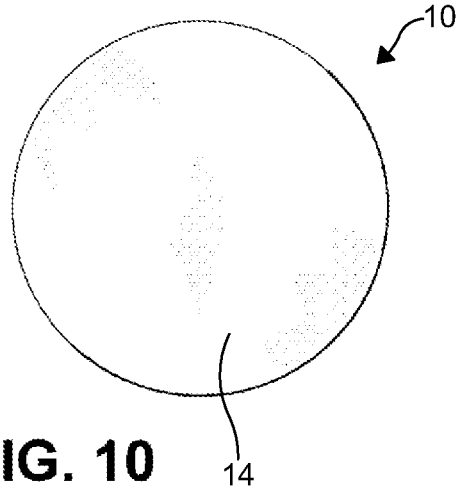
FIG. 10 is a bottom plan view of the receptacle of FIGS. 6-9.

In the open position and the expanded position, the bottom 16 and the sides 14 define a chamber 20. The sides 14 define a pair of slots 22*a*, 22*b* wherein edges 23 of one of the sides 14 are spaced from edges 23 of the other one of the sides 14. As shown in FIGS. 1-2, in the expanded position, the slots 22*a*, 22*b* define a shape having an upper first portion 22*a* with a substantially rectangular shape and a lower second portion 22*b* having a shape that is substantially bell shaped.

A first connector 24 connects one of the edges 23 of the one of the sides 14 to an adjacent edge 23 of the other one of the sides 14. A second connector 26 connects the other one of the edges of the one of the sides 12 to an adjacent edge 23 of the other one of the sides 14. In the embodiments illustrated, the connectors 24, 26 are configured as a pair of elastic straps: a first strap 28 and a second strap 30. The straps are rectangular in shape. However, the straps can be any shape as desired. The ends 32 of the straps engage an inner surface 34 of the sides 14. Although, if desired, the straps 28, 30 can engage an outer surface 36 of the sides 14. A central portion 38 of the straps 28, 30 is exposed to the outside of the receptacle 10 through the slots 22*a*, 22*b*.

FIGS. 11-13 illustrate the receptacle 10 in the collapsed position, the expanded position and the extended position respectively. The sides 14 include indicia 40 formed thereon. The indicia 40 can be any color, shape, letter, advertisement, logo, or combination thereof. The indicia 40 is applied by a printing process such as laser printing, screen printing, ink jet printing, or the like. Although, the indicia 40 can be applied by any other application process as desired.

As shown in FIG. 12, a container 100 such as a beverage container is received through the opening 18 of the receptacle 10. As shown in FIG. 12, the sides 14 of the receptacle 10 can be expanded to the expanded position to allow easy insertion of the container 100 into the receptacle 10. FIG. 13 illustrates the receptacle 10 being stretched to the extended position.

In the embodiment illustrated in FIGS. 6-10, the receptacle 10 is substantially the same as the embodiment described hereinabove with respect to FIGS. 1-5 and FIGS. 11-13. However, the connectors 24, 26 are formed from a single unitary strap. It is understood, in other embodiments the connectors 24, 26 can be formed from more than two straps if desired. As shown, the connectors 24, 26 are formed from an elastic or expandable material. The expandable material permits an overall diameter of the receptacle 10 to expand, which allows the receptable 10 to accept containers 100 of various diameters while maintaining a grip on the container.

To manufacture the receptacle 10, the wrap 12 can be formed from a blank, wherein the wrap 12 is flat. This permits easy printing of the wrap 12 before attaching the connectors 24, 26 thereto. Also, the cost of forming the wrap 12 is minimized. The connectors 24, 26 can be coupled to the sides 14 by any coupling method such as an adhesive, stitches, a hook and loop apparatus, melting process, or any other coupling method as desired.

Advantages include, but are not limited to, ease of manufacturing and printing, easy expandability and collapsibility, maximization of storage space, insulation of the container 100, militation against buildup of condensation, facilitation of grip on the container, and protection of a holder of the container 100 in the receptacle 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A receptacle comprising:

a wrap configured to define a chamber for receiving a container, wherein the wrap is formed from a single continuous blank of one single piece of material;

a pair of slots formed in the wrap, defining a bottom and two sides;

a first connector exposed through a first one of the pair of slots and coupled to an inner surface of the wrap, wherein the first connector consists of a pair of elastic straps spaced from each other, wherein a first space is defined between the first connector and the bottom of the wrap, a second space is formed between the pair of elastic strips of the first connector, wherein the first connector is spaced from a top edge of the wrap, and wherein the pair of elastic straps of the first connector extends horizontally between the two sides with respect to the bottom of the wrap; and a second connector exposed through a second one of the pair of slots and coupled to the inner surface of the wrap, wherein the second connector consists of a pair of elastic straps spaced from each other and horizontally aligned with the pair of elastic straps of the first connector, wherein the pair of elastic strips of the first connector, a fourth space is formed between the pair of elastic straps of the first connector, wherein the second connector is spaced from the top edge of the wrap, and wherein the pair of elastic straps of the second connector extends horizontally between the two sides with respect to the bottom of the wrap.

2. The receptacle of claim 1, wherein the first connector and the second connector are coupled to the inner surface of the wrap directly facing the chamber.

3. The receptacle of claim 1, wherein the receptacle is configured to receive a twelve ounce can of a beverage.

4. The receptacle of claim 1, wherein the receptacle is configured to be positioned between a collapsed position, an expanded position, and an extended position.

5. The receptacle of claim 1, wherein indicia is formed on the surface of the wrap.

6. A receptacle comprising:

a wrap configured to define a chamber for receiving a container, wherein the receptacle is configured to be positioned between a collapsed position, an expanded position, and an extended position;

a pair of slots formed in the wrap, defining a bottom and two sides, wherein, in the collapsed position, the bottom of the wrap folds upon itself to move the two sides in a direction toward each other so that each of the sides are substantially linear with a portion of the bottom, and wherein in the expanded position each of the pair of slots define a shape having an upper first portion and a lower second portion adjacent the bottom, the upper first portion having a substantially rectangular shape and the lower second portion is substantially bell shaped;

a first connector exposed through a first one of the pair of slots and coupled to a surface of the wrap, wherein the first connector consists of a first pair of elastic straps, wherein, in the collapsed position, the first pair of elastic straps extend arcuately outwardly from the wrap, wherein, in the expanded position, the first pair of elastic straps are substantially circumferentially aligned with the wrap, and wherein, in the extended position, the first pair of elastic straps is planar between the two sides; and a second connector is exposed through a second one of the pair of slots and coupled to the surface of the wrap, wherein the second connector comprises a second pair of elastic straps.

7. The receptacle of claim 6, wherein the wrap includes indicia thereon.

8. The receptacle of claim 6, wherein the receptacle is formed from a blank.

9. The receptacle of claim 6, wherein the receptacle is configured to receive a twelve ounce can.

10. The receptacle of claim 6, wherein the first connector and the second connector are coupled to an inner surface of the wrap.

* * * * *